United States Patent [19]

Marchessault

[11] 4,094,035

[45] June 13, 1978

[54] CURLING BROOM

[76] Inventor: Fernand Marchessault, 2251 Sherbrooke Street, East, Montreal, Quebec, Canada

[21] Appl. No.: 445,814

[22] Filed: Feb. 25, 1974

[51] Int. Cl.[2] ..... A46B 3/06; A63B 67/14

[52] U.S. Cl. ..... 15/160; 15/159 A; 15/193

[58] Field of Search ..... 15/159 A, 160, 168–171, 15/189, 193, 207, DIG. 3, DIG. 4

[56] References Cited

U.S. PATENT DOCUMENTS

| | | | |
|---|---|---|---|
| 117,844 | 8/1871 | Willis | 15/207 X |
| 1,315,194 | 9/1919 | Yamamoto | 15/171 |
| 2,653,056 | 9/1953 | Montero et al. | 15/193 X |
| 2,934,777 | 5/1960 | Hanset | 15/193 X |
| 3,186,018 | 6/1965 | Shaw | 15/159 A UX |
| 3,239,865 | 3/1966 | Munt | 15/159 R |
| 3,295,156 | 1/1967 | Brant | 15/159 A UX |
| 3,328,823 | 7/1967 | Forbes | 15/160 |
| 3,357,038 | 12/1967 | Williamson et al. | 15/187 X |
| 3,416,179 | 12/1968 | Wiese | 15/171 |
| 3,806,981 | 4/1974 | Flemming et al. | 15/160 |

FOREIGN PATENT DOCUMENTS

| | | | |
|---|---|---|---|
| 818,155 | 7/1969 | Canada | 15/160 |
| 919,865 | 1/1973 | Canada | 15/160 |

*Primary Examiner*—Daniel Blum

[57] ABSTRACT

Brooms made of synthetic fibers and having the necessary characteristics to be used for curling. Brooms of synthetic fibers wherein the essentially non-springiness of such fibers is compensated by inserting a resilient means within the bundle of fibers, such means being arranged to produce whipping as the usual curling broom without marring the ice. A flexible sheet is inserted between each side of the resilient means and the fibers. The fibers are loosely stitched or bound together to permit fiber flexing.

5 Claims, 35 Drawing Figures

31
32
30
18
18
33
25
34
23
23
27

13
31
32
25
28
26
27
13

35
31
36
26
27

15
15
26
27

26
27

17
2
2a
2b
2c
2d
2e
17

2f
2g 11
28
25
29
29
26
25

CURLING BROOM

This invention relates to brooms and, more particularly, to brooms made of synthetic fibers and to be used for curling.

The brooms which have been used so far were made of natural fibers mainly corn fibers and attempts to use synthetic fibers were not successful owing to the fact that synthetic fibers are essentially not resilient.

The curling broom, in particular, must meet stringent characteristics among which, substantial springiness to be whippy, wear resistance and freedom of the fibers relative to a lowermost stitching to allow sufficient freedom and flexing of the fibers.

The applicant, who is the inventor of the curling broom of Canadian Pat. No. 656,934 of Jan. 29, 1963, a re-issue of U.S. Pat. No. 554,826 of Mar. 25, 1958, has been experimenting with synthetic materials for curling brooms for about 15 years.

His researches during this period of time proved that the only way synthetic materials could be used for the production of curling brooms, was to have resilient means installed in the center of brooms to give said synthetic materials the resiliency and springiness that chemistry has not yet been able to give to said synthetic materials.

Fine synthetic fibers of a diameter from 15 to 45 mils maximum for use on the outside part of a curling broom have no whip or resiliency like natural broom corn from which conventional curling brooms are made, because they are too fine and they are not tapered like natural fibers; machinery is not yet made to produce tapered synthetic fibers about 20 inches long.

Although brooms made with synthetic fibers do scratch the ice a little under very heavy sweeping, they nevertheless are accepted, because:

1. The brooms last longer than the ones made of broom corn.
2. They do not shed debris or particles on the ice, whereas brooms made from natural broom corn do wear out faster and do shed particles on the ice under heavy sweeping, and said debris do sometimes divert curling stones from their path. On the other hand, brooms made from broom corn are still the best sweeping brooms on the market, as nothing has yet been produced to match their smoothness and flexibility.

It is a general object of the invention to provide a broom which can be made of synthetic fibers while still having the desired springiness.

It is another general object of the invention to provide a broom which is made of synthetic fibers while maintaining the necessary characteristics to be used for curling.

It is a more specific object of the invention to provide a broom with a resilient means concealed within the fibers to impart springiness thereto and thence compensate for non-springiness of the fibers.

It is a further object of the invention to make a broom of synthetic fibers which has characteristics very similar to natural broom corn curling brooms, which are what curlers want.

The above objects and other objects and advantages of the invention will be better understood in the light of the following description of preferred embodiments which are illustrated, by way of example only, in the accompanying drawings, in which.

Figures 1, 2, 3, 4, 5, 6, 7, 8, 9, 10:
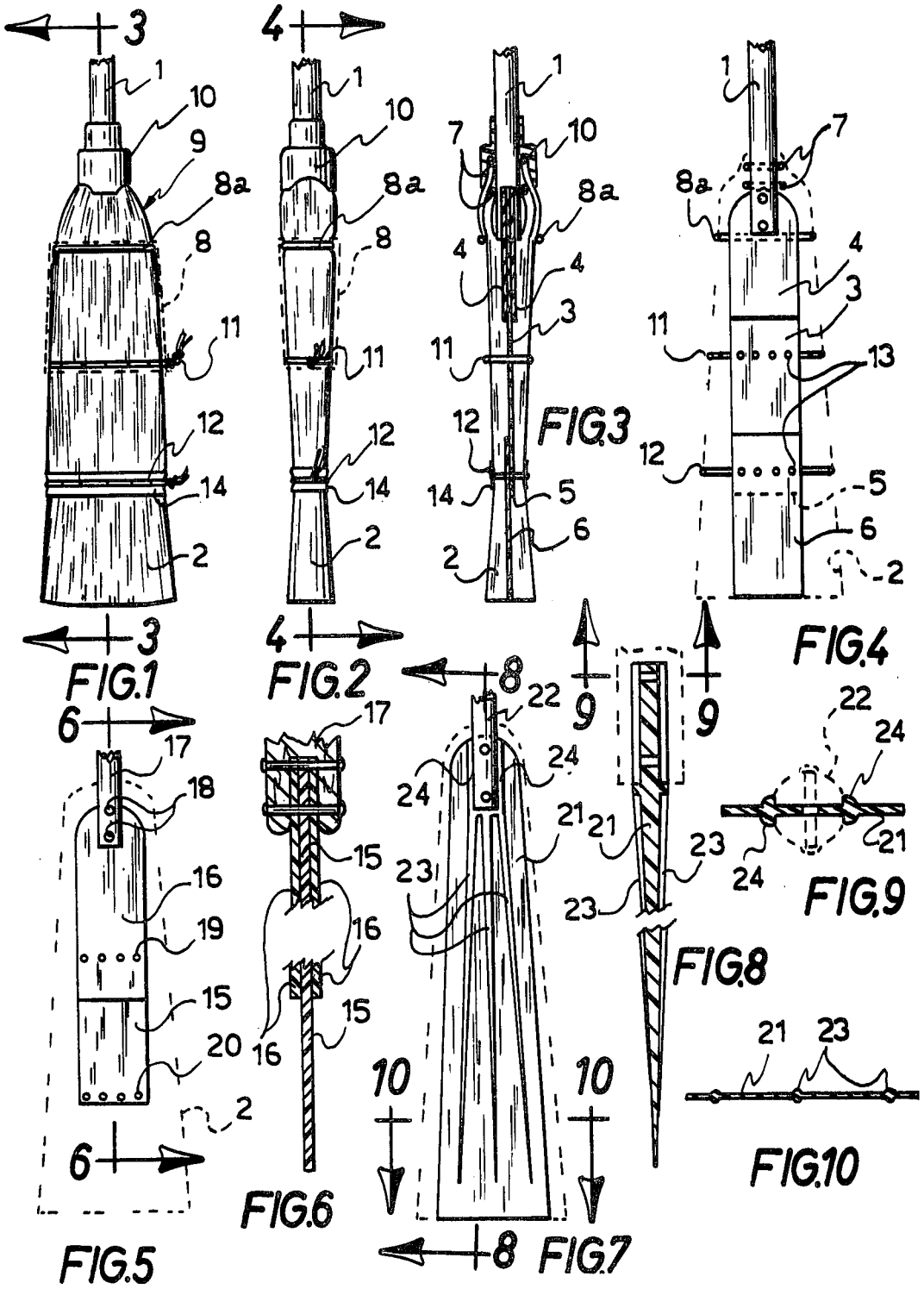
FIG. 1 is a front elevation view of a first embodiment of a broom.
FIG. 2 is a side elevation view of the broom illustrated in FIG. 1.
FIG. 3 is a longitudinal section taken along line 3—3 of FIG. 1.
FIG. 4 is a plan section taken along line 4—4 of FIG. 2.
FIG. 5 is a view similar to that of FIG. 4 but showing another embodiment of the resilient means.
FIG. 6 is a partial longitudinal section taken along line 6—6 of FIG. 5.
FIG. 7 is a plan view of another embodiment of the resilient means.
FIG. 8 is a longitudinal section taken along line 8—8 of FIG. 7.
Figures 11, 12, 13, 14, 15, 16, 17, 18:
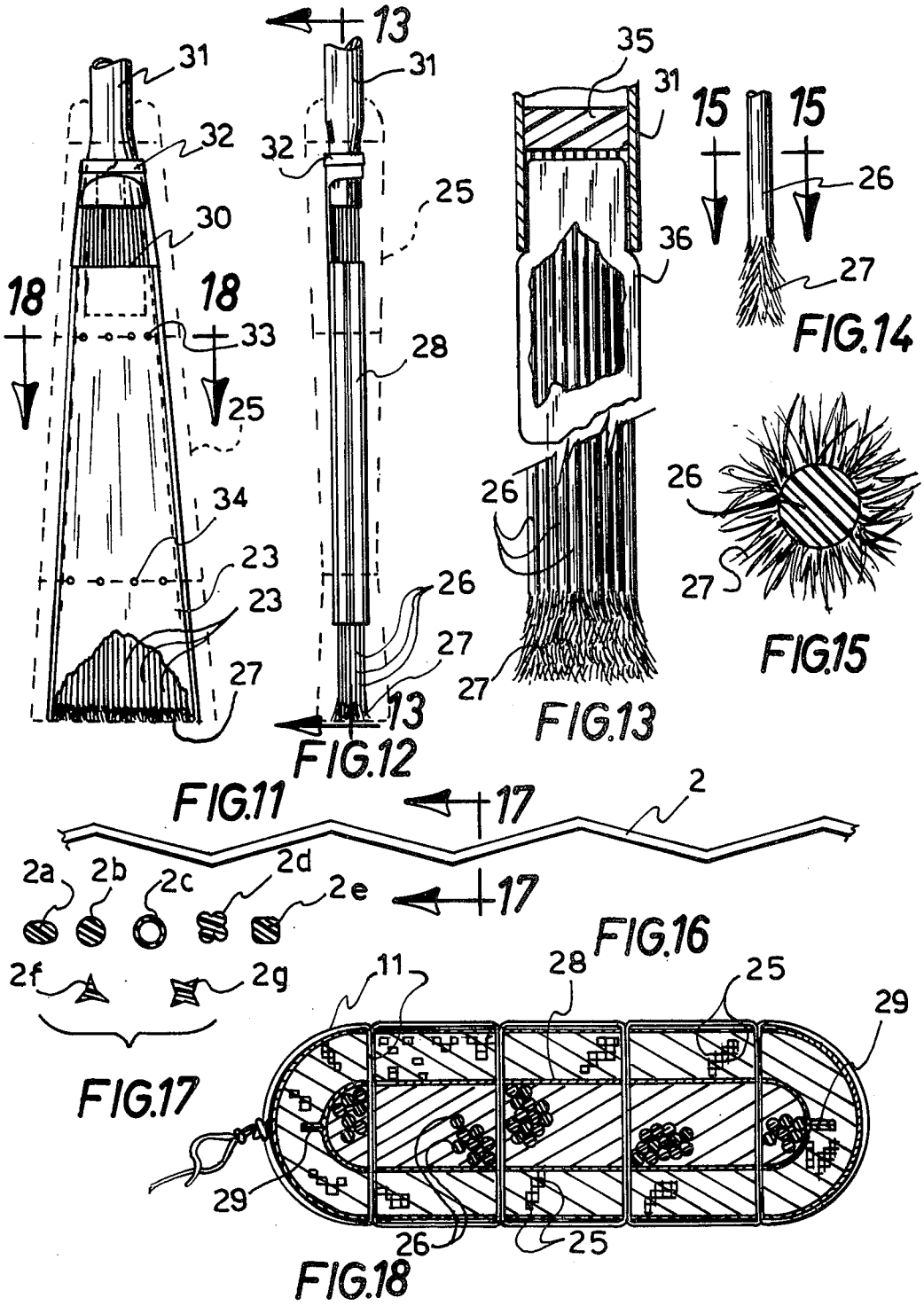
Figure 19:
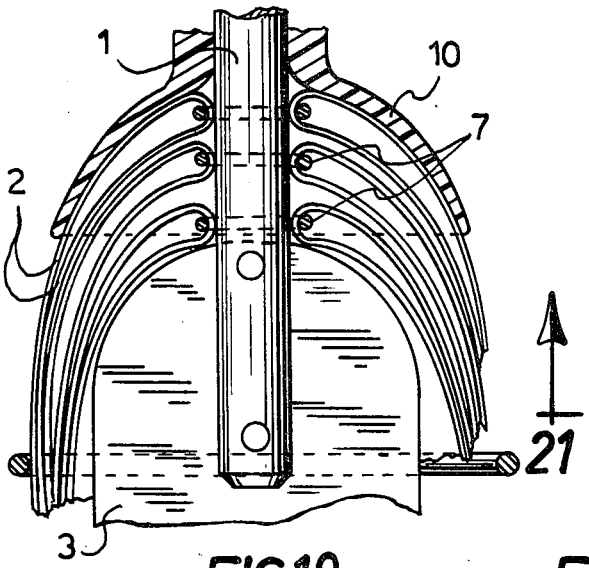
Figure 20:
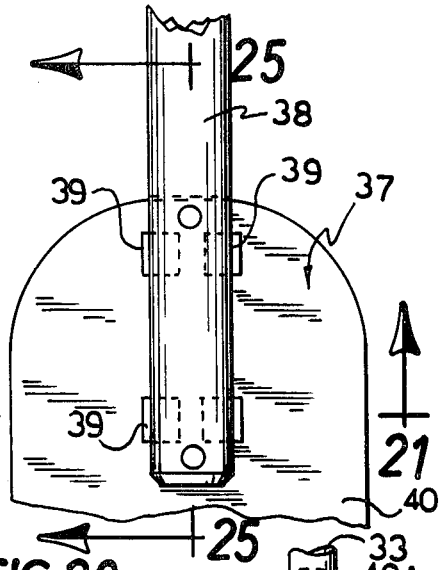
Figure 21:
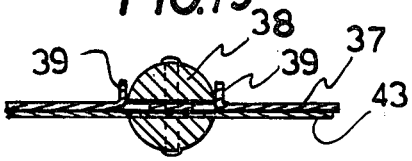
Figure 23:
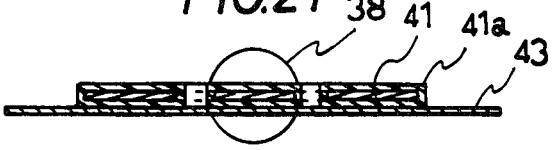
Figure 24:
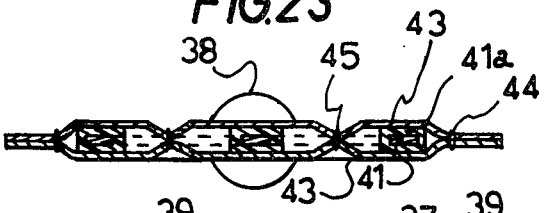
Figure 25:
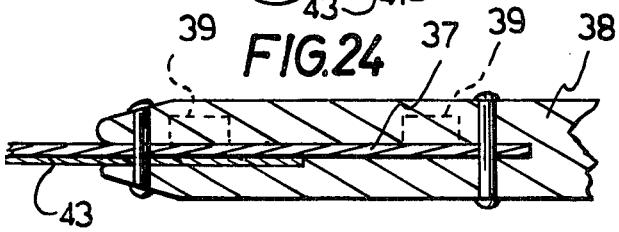
Figure 22:
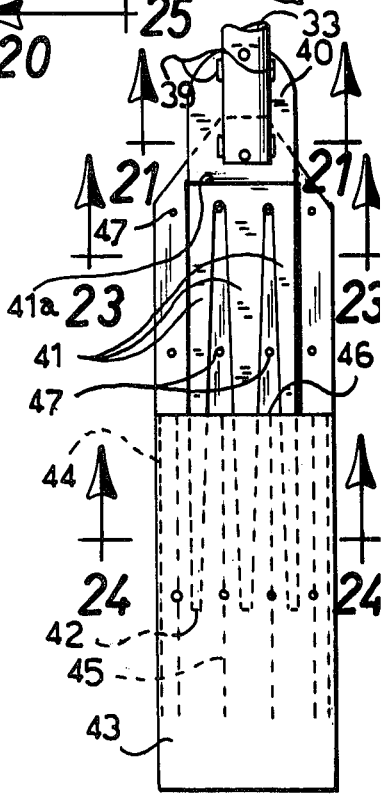
Figure 30:
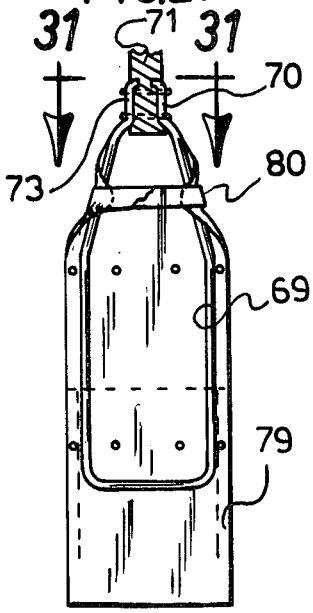
Figure 31:
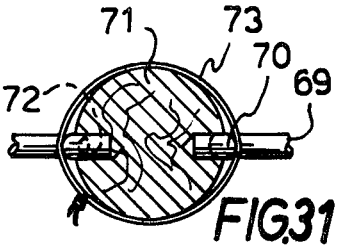
Figure 32:
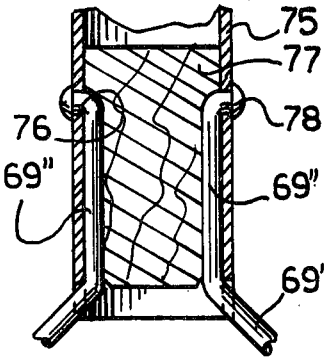
Figure 34:
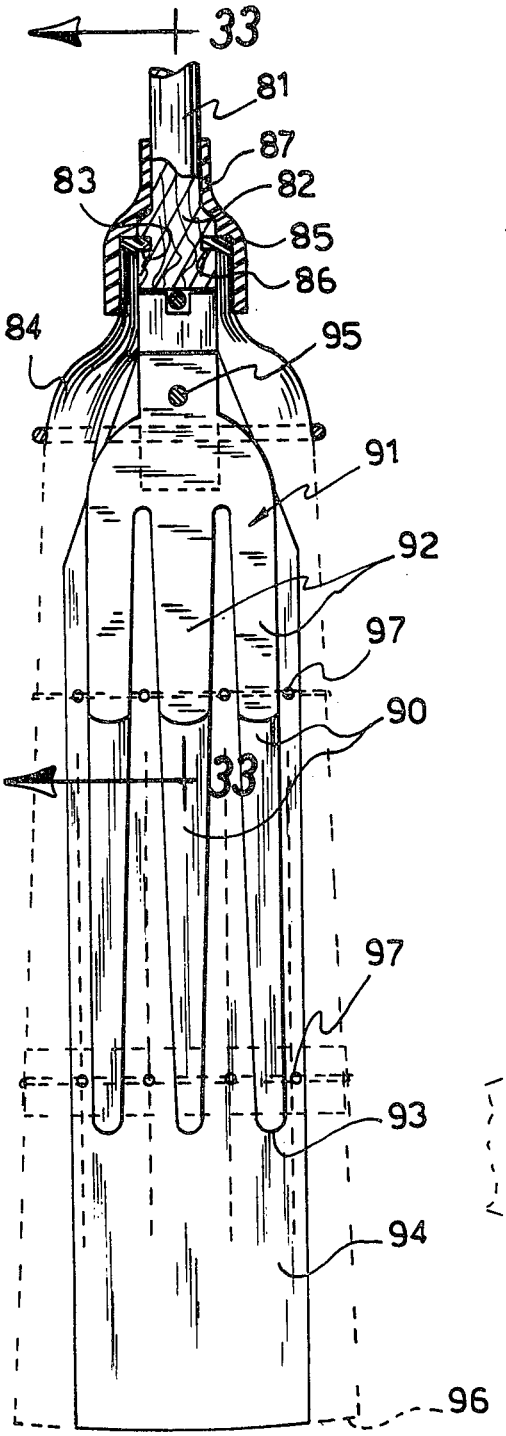
Figure 33:
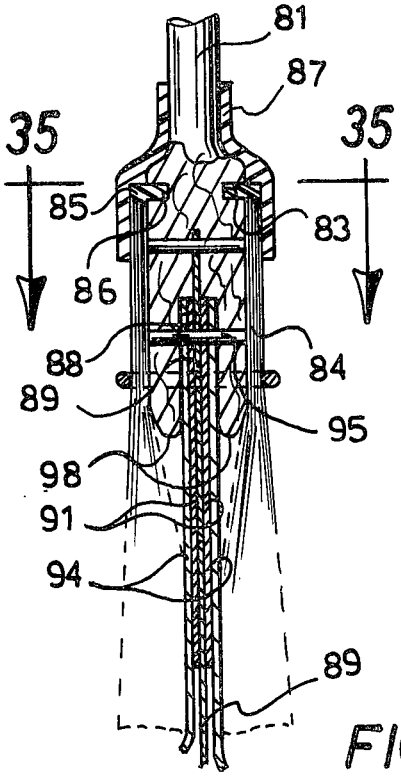
Figure 35:
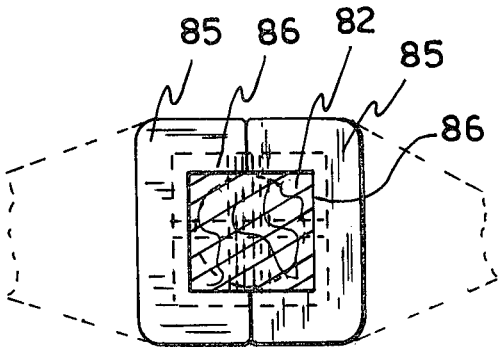

FIGS. 9 and 10 are cross-sections taken along lines 9—9 of FIG. 8 and 10—10 of FIG. 7, respectively;

FIG. 11 is a plan view of the resilient means in accordance with the preferred embodiment, the resilient means consisting of a bundle of coarse fibers;

FIG. 12 is a side elevation of the embodiment of FIG. 11;

FIG. 13 is a longitudinal section, broken away on a larger scale, taken along line 13—13 of FIG. 12;

FIG. 14 is a partial elevation of the outer end portion of a coarse fiber;

FIG. 15 is a cross-section, on an enlarged scale, taken along line 15—15 of FIG. 14;

FIG. 16 is a partial elevation of one outer fiber of the broom;

FIG. 17 shows various possible cross-sections of the fiber of FIG. 16 and taken along line 17—17 of FIG. 16;

FIG. 18 is a cross-section of the entire broom having the resilient means shown in FIG. 11 and taken along line 18—18 of FIG. 11;

FIG. 19 is a partial plan view of the resilient means of the broom of FIG. 1, the handle and one manner of securing the outer fibers to the handle;

FIG. 20 is a partial plan view of a resilient means consisting of a metal spring blade and showing the manner of securing the spring blade to the handle;

FIG. 21 is a cross-section along line 21—21 of FIG. 20;

FIG. 22 is a plan view of the resilient means in accordance with FIG. 20 and showing the entire embodiment;

FIGS. 23 and 24 are cross-sections taken along line 23—23 and 24—24, respectively, of FIG. 22;

FIG. 25 is a longitudinal section taken along line 25—25 of FIG. 20;

FIGS. 26 to 30 inclusive show additional embodiments of the resilient means;

FIG. 31 is a cross-section, on an enlarged scale, taken along line 31—31 of FIG. 30;

FIG. 32 is a longitudinal section of another embodiment of the means for securing the resilient means to the handle;

FIG. 33 is a longitudinal section of another embodiment of the curling broom and taken along line 33—33 of FIG. 34;

FIG. 34 is a plan section of the same embodiment of the curling broom shown in its entirety; and FIG. 35 is a cross-section taken along line 35—35 of FIG. 33.

In the drawings, like reference characters indicate like elements throughout.

The broom in accordance with the first embodiment illustrated in FIGS. 1 to 4 and FIG. 19 comprises a handle 1, to one end of which is secured the head end 9 of a bundle of fibers 2, made of synthetic resin and preferably thermoplastic material, such as polyethylene or polypropylene. The handle 1 may be the usual wood handle or may be of tubular metal construction, for instance aluminum. The fibers 2 are preferably krinkled, as shown in FIG. 16, to impart to the bundle of fibers a greater volume. Each individual fiber may have any cross-sectional shape, as shown in FIG. 17; for instance, it may be oval shape, as shown at *2a;* circular shape, as shown at *2b;* cylindrical shape, as shown at *2c;* a square shape with four protruding and rounded corner edges, as shown at *2d;* a square shape with rounded corners, as shown at *2e;* a triangular shape, as shown at *2f;* or a rectangular shape with sharp protruding corners, as shown at *2g*.

Sharp edges increase the sweeping efficiency. However, they may have a tendency to remove or to smoothen the pebbled surface of the ice on which the curling stone revolves. The cross-sectional dimension of the fibers may preferably vary between 20 and 45 thousandths of an inch. Obviously, the coarser is the fiber the greater is the possibility of marring the ice under heavy sweeping.

A blade 3, of resilient material, either plastic or metal, is fixed at one end to the handle 1 in the longitudinal extension thereof. The resilient flat blade 3 is inserted into a longitudinal slot in the end of handle 1 between a pair of other resilient blades 4, also made of plastic or metal, such as steel. These blades 4 terminate short of the outer end 5 of center blade 3, serve to increase the whippy flexion of the resilient center blade 3 and also to prevent undue flexion of the same in an area adjacent handle 1. The resilient means constituted by the assembly of blade 3 and short blades 4 is completely concealed within the bundle of synthetic fibers 2. The outer end 5 of center blade 3 terminates short of the outer end of the fibers 2.

A sheet of flexible material, such as leather, indicated at 6, forms a flexible extension of center blade 3 being secured to the outer end of the latter in overlapping relationship. The outer end 5 of center blade 3 cannot mar the ice, because it terminates short of the fibers 2. Flexible sheet 6 increases the sweeping efficiency of the fibers.

The fibers 2 are arranged into layers, as best shown in FIG. 19, such that each layer of fibers is folded around a fixing wire 7 and the fibers 2 are thence doubled with their opposite ends extending away from the corresponding fixing wire 7. The fixing wires surround the handle 1 and secure the respective layers of fibers in spreaded relationship along handle 1. There results a thinner arrangement of the fibers around the lower end of handle 1.

A metal wire 8*a* is fixed around the head 9 of the fibers 2 in firm engagement with the fibers 2. Decorative fabric 8 also surrounds head 9. A plastic cover 10, as shown in FIG. 19 and also in FIGS. 1 to 3 inclusive, may be positioned over the junction between the head 9 and the handle 1 to produce a better appearance.

Binding means are provided to maintain the fibers 2 spreaded across the width of blade assembly 3 and 4 and the flexible sheets 6 and to retain the fibers 2 against the blade 3 and sheet 6. Said binding means include an upper string 11 and a lower string 12, both stitched through the bundle of fibers 2 and extending through corresponding holes 13 made in the resilient blade 3. At least the lower string 12 is loosely stitched around the fibers so as to permit longitudinal movement of said fibers with respect to the string 12 when the fibers are flexed. Both strings 11 and 12 are suspended from the handle by the blade 3, which serves as suspension means for the stitched strings 11 and 12.

As shown in FIG. 1, at least the lower string 12 is applied against a band 14, for instance made of cotton fabric, surrounding the fibers 2 and serving to prevent excessive wear of the fibers by the lower binding 12 and to keep the fibers in compact condition together with string 12.

FIGS. 5 and 6 show another embodiment of the inner resilient means. An assembly of a center longer resilient blade 15 and two outer superposed shorter blades 16 are inserted within the slot of handle 17 and secured thereto by rivets 18 or the like.

Blades 15 and 16 are preferably made of plastic and an upper row of holes 19 are made through the blades 15 and 16, while a lower row of holes 20 are made through the center blade 13 adjacent the outer end thereof, both to receive the strings for effecting binding at the upper and lower level and corresponding to bindings 11 and 12 of the first embodiment.

FIGS. 7 to 10 show another embodiment of the resilient means. It consists of an elongated tapered blade 21, made of synthetic resin, flaring outwardly from its end secured to handle 22 and of progressively decreasing thickness from its end secured to handle 22 towards its outer end, as clearly shown in FIG. 8.

Blade 21 is further provided with longitudinally extending ribs 23 on both faces thereof to reinforce the blade and also with rib portions 24 extending alongside the handle 22 and abutting against the same and serving to positively align the blade 21 with the handle.

The bindings, such as binding strings 11 and 12, are stitched through the bundle of fibers and also through the thin blade 21 without having to pre-perforate the same.

FIGS. 11 and 15 and 18 show another embodiment of a curling broom, including a modified core serving as resilient means to impart springiness to the outer fibers, shown at 25 in FIG. 18, and the outline of which is also shown by the dotted line at 25 in FIG. 11.

With each outer fiber 25 having a cross-sectional size varying between 20 to 40 mils and made of polypropylene, polyethylene or nylon, the inner core serving as resilient means thereto consists of a bundle of coarse fibers 26 of a cross-sectional area much larger than the cross-sectional areas of the outer fibers 25. For instance, the coarse fibers 26 may vary between 60 and 120 mils in diameter. They are preferably made of the same material as fibers 25. They form a longitudinally extending bundle aligned with the handle and are completely surrounded by the outer fibers 25. They preferably extend to the outer end of the outer fibers 25 but may terminate short thereof, and their outer ends are flagged or tufted, as shown at 27 in FIGS. 13 to 15, so as to prevent marring the ice or damaging the outer fibers. Flagging is preferably effected by subjecting the outer ends of the coarse fibers 26 to the action of a rotary toothed wheel.

The bundle of coarse fibers 26 is surrounded by a sleeve 28 of flexible sheet material, such as leather or leatherette, which separates the coarse fibers 26 from the outer fibers 25. The sleeve 28 may be made of two sheets, as shown in FIG. 18, stitched together along their edges, as shown at 29. One sheet may terminate at its upper end at 30 in FIG. 11 short of handle 31, while the other sheet extends over handle 31 and is folded around the same and retained thereon by a pressure adhesive tape 32. The upper and lower lines of stitching 11 and 12 are effected at the levels indicated by holes 33 and 34 made in the sleeve 28. The stitching is effected through the assembly of the outer fibers 25 and coarse fibers 26. Of course, holes 33 and 34 need not be pre-perforated.

A preferred manner of securing the coarse fibers 26 in alignment with handle 31 is as follows:

The head ends of the coarse fibers 26 are tightly fitted in a short cylindrical nipple and are subjected to intense heat to melt the ends of the coarse fibers. Upon solidification of the molten ends, there is formed a solid plug 35 with which the ends of the fibers 26 are integral and firmly secured. The resulting assembly of the fibers can then be inserted within the outer end of tubular metal handle 31. Then the tubular handle 31 is flattened below the plug 35, as clearly shown in FIG. 12, to firmly hold the bundle of coarse fibers in position within the handle.

Preferably, a spring steel blade 36, shown in FIG. 13, is inserted between the coarse fibers 26, which are then separated thereby into two half-bundles. The head end of blade 36 is secured within the tubular handle by a cross-pin, not shown. Blade 36 serves to prevent undue flexing of the coarse fibers 26 at the level of the outer end of tubular handle 31.

Whenever the resilient means consist of a steel spring blade, such as shown at 37 in FIG. 20, a preferred manner of maintaining the same in alignment with the handle 38 is to provide punched-out lugs or tabs 39 in the blade 37 formed to engage and abut opposite sides of the handle at at least two longitudinally spaced zones thereof, as shown in FIGS. 20 and 21. Thus, the lugs serve to accurately and easily align the handle relative to the blade 36 and to resiliently maintain the same in alignment.

Spring blade 37 can be formed, as shown in FIG. 22, of a head portion 40 fixed to handle 38 and forming a fork-like member providing a plurality of outwardly tapering tines 41 terminating at 42 short of the outer end of the outer fibers of the broom. The tines are preferably coated with a plastic layer 41*a*. The tines are at least partially inserted within a glove-like member 43 consisting of two layers of flexible material stitched together along their longitudinal edges at 44 and provided with additional longitudinal stitching lines 45 forming individual compartments for the respective tines 41.

The glove 43 extends to the outer end of the outer fibers. One side of the glove terminates at 46, while the other side extends upwardly to be inserted within the slot of the handle 38 along with the spring blade 37 to be inserted within the slot of the handle 38 along with the spring blade 37 to be attached to the handle. The glove is preferably provided with pre-perforated holes 47 arranged at different levels and opening between the tines to receive the strings for stitching the outer fibers, such as the lines of stitching 11, 12. The glove 43, made of flexible material, serves to protect the fibers 2 against wear by the resilient blade 37 to prevent passage of the tines 41 between the fibers when the broom is flexed, to impart additional body to the fibers for more efficient sweeping and to suspend the loose stitchings from the handle.

Figure 26:
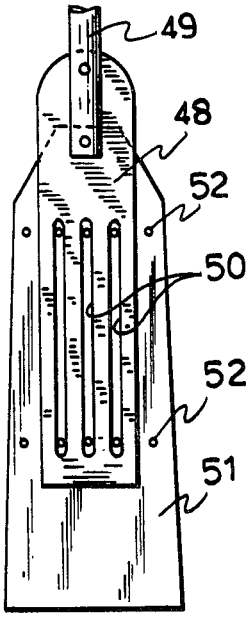

FIGS. 26 to 30 show further embodiments of the inner resilient means. In FIG. 26, the steel spring blade 48, attached to handle 49, is provided with a plurality of elongated longitudinally extending slots 50 transversely spaced with respect to the blade. A flexible sleeve 51, attached to the handle 49 at one end, extends on one or on both sides of the blade 48 and is preferably provided with at least two series of transversely extending rows of holes 52 receiving the stitching lines 11,12; holes 52 register with slots 50. The sleeve 51 serves to suspend the loose stitching from the handle and the stitching is allowed to move longitudinally with respect to the blade 48 during flexing.

Figure 27:
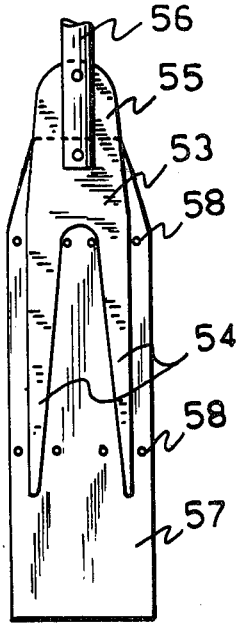

In FIG. 27, a flat spring blade 53, forming two spaced tines 54, is fixed at its head end 55 to handle 56. A flexible sleeve 57, such as leatherette, is secured to handle 56 together with blade 53, surrounds the blade 53 and is provided with stitching receiving holes 58 arranged in two longitudinal rows. The sheet 57 extends preferably to the outer end of the outer fibers of the broom.

Figure 28:
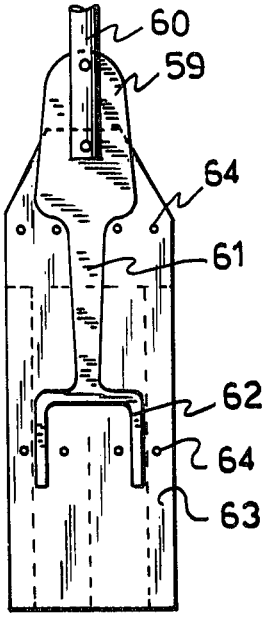

In FIG. 28, the spring blade is composed of a head portion 59 secured to handle 60 and central restricted portion 61 terminated by a U-shape member 62. The flexible sheet 63 is secured to handle 60 and is provided with stitching receiving holes 64.

Figure 29:
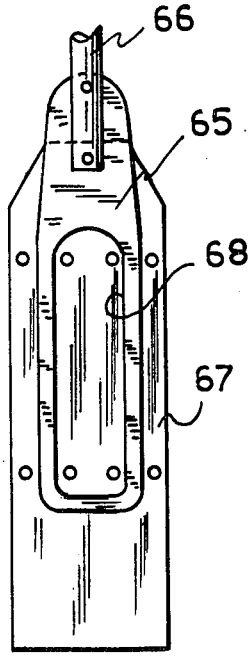

In FIG. 29, the spring blade 65 is secured at one end to the handle 66 together with the sheet member 67 and is provided with an enlarged opening 68. FIG. 30 shows that resilient means can be provided by a spring wire 69, of circular cross-section, and bent into a U-shape. The end portions 70 of the wire 69 are parallel to each other and are secured to handle 71 in the following manner:

Handle 71 is provided with diametrically opposite longitudinally extending grooves 72 receiving end portions 70 and the outer ends of said end portions are bent inwardly at substantially right angles to enter holes or blind bores made in handle 71. The two end portions and the handle are surrounded by tight wires 73, or the like, for retaining the end portions 70 into the groove 72, resulting in a simple and efficient manner to rigidly secure the wire 69 in alignment with the handle 71, the latter being made of solid material, such as wood or the like.

When the handle is made to be separable from the broom itself, a preferred manner of securing the wire 69' to the handle is as follows:

A tubular nipple 75 is provided with diametrically opposed holes 76. The outer ends of the wire 69' are outwardly bent at right angles and inserted into the holes 76. Then a wooden plug 77, provided with longitudinally extending grooves, is pushed through the nipple to engage the end portions 69'' of the wire 69'. Then the outer ends of the wire 69' are flattened to form a rivet head 78 on the outside of nipple 75. A wooden handle, not shown, is releasably tightly fitted within the outer end of the nipple 75. In FIG. 30, the flexible sleeve 79 is attached to the inclined portions of wire 69 by a pressure sensitive adhesive tape 80.

FIGS. 33 to 35 inclusive show still another embodiment of the invention. A round wooden handle 81 has an enlarged end portion 82, of square cross-section, which is provided all around with a groove 83 transverse to the handle long axis.

The outer fibers 84, which are made of a thermoplastic material, are formed of two separate bundles. The fibers 84 of each bundle are all secured together at their head ends. More particularly, the fiber ends are embedded into a mass 85 of the same thermoplastic material as the fibers 84. This can be done by inserting the ends of the fibers in a mold and subjecting the fiber ends to heat to melt the same. The mass 85 forms a ridge 86 protruding from the inner face of the fibers of the bundle, that is from the face of the fibers adapted to face the fibers of the other bundle.

Each ridge 86 of each bundle forms a U-shape, as shown in FIG. 35, when seen in end elevation, each adapted to fit within the groove 83 from each side of the handle, so that it is very easy to assemble the two bundles on the handle. Then the two head portions of the bundles are surrounded by a pressure adhesive tape and then the assembly is covered by a plastic cap 87. The handle end portion 82 is provided with a slot 88 for receiving and retaining the resilient means.

These resilient means consist of a center spring blade 89, shaped to form three tines 90 and disposed between two outer spring blades 91, also provided with three tines 92, each superposed on the tine 90 of the center blade 89 but terminating short of the outer ends 93 of the tines 90 of center blade 89.

The assembly of blades 89 and 91 is inserted within a glove 94, of flexible sheet material, which is retained to the handle by being inserted within the slot 88 along with the blades 89, 91, the entire assembly being secured by cross-pins 95. The outer ends 93 of the center blade 89 terminate short of the outer end of the outer fibers, as shown at 96. The glove 94 extends to the outer end 96 of the fibers 84. The glove 94 is preferably provided with longitudinally spaced rows of holes 97 for receiving the stitching or bindings 11 and 12.

The outer blades 91 prevent flexing of the center blade 89 at too short a radius of curvature in the region of handle 81 and imparts along with the center blade the desired springiness to the outer fibers. The glove 94 protects the outer fibers against damage by the tines 90, 92; serve to suspend the loose binding from the handle; imparts additional body to the fibers for better sweeping efficiency; and, being flexible, does not diminish the flexibility of the broom fibers.

As shown in the various Figures, including FIG. 33, the ends of the wooden handle are rounded, as shown at 98, on each side of the slot 88 to prevent denting of the blades and damage to the fibers during flexing.

What I claim is:

1. A broom comprising an elongated resilient means, a handle having one end secured to one end of said resilient means, and aligned therewith, fibers made of synthetic material, fixing means securing said fibers to said one end of said handle, said fibers extending longitudinally of said resilient means, encompassing the latter, and arranged for flexion with said resilient means to be resiliently displaced by the latter, and a low binding loosely surrounding said fibers and maintained against longitudinal displacement relative to said handle, said low binding keeping said fibers against said resilient means, said resilient means including a bundle of coarse fibers of synthetic thermoplastic material, each having a cross-sectional area much larger than the cross-sectional area of the first-named fibers, said low binding loosely stitched through said bundle of coarse fibers, the ends of said coarse fibers secured to said handle being embedded in a solid plug, said plug holding said fiber ends together, and wherein said handle has a tubular portion and said plug and end portions of said coarse fibers embedded in said plug are fitted in said tubular portion and said tubular portion is flattened over said coarse fibers below said plug.

2. A broom as defined in claim 1, wherein the outer end portions of said coarse fibers are flagged or tufted.

3. A broom comprising an elongated resilient means, a handle having one end secured to one end of said resilient means, and aligned therewith, fibers made of synthetic material, fixing means securing said fibers to said one end of said handle, said fibers extending longitudinally of said resilient means, encompassing the latter, and arranged for flexion with said resilient means and to be resiliently displaced by the latter, and a low binding loosely surrounding said fibers and maintained against longitudinal displacement relative to said handle, said low binding keeping said fibers against said resilient means, said resilient means including a bundle of coarse fibers of synthetic thermoplastic material, each having a cross-sectional area much larger than the cross-sectional area of the first-named fibers, said low binding loosely stitched through said bundle of coarse fibers, and further including a sleeve of flexible sheet material surrounding said coarse fibers and separating the same from said first-named fibers, said sleeve attached to the assembly of said handle and said coarse fibers and supporting said binding.

4. A broom as claimed in claim 3, further including an elongated spring blade having one end secured to said one end of said handle and inserted between said coarse fibers and separating the same into two half-bundles to prevent undue flexing of said coarse fibers.

5. A broom as defined in claim 3, wherein the outer end portions of said coarse fibers are flagged or tufted.

* * * * *

UNITED STATES PATENT AND TRADEMARK OFFICE

CERTIFICATE OF CORRECTION

PATENT NO. :4,094,035

DATED :June 13, 1978

INVENTOR(S) :Fernand Marchessault

It is certified that error appears in the above-identified patent and that said Letters Patent are hereby corrected as shown below:

On the cover sheet insert Item (30) Foreign Priority data:

-- Canada 164,861 February 28, 1973 --.

Signed and Sealed this

*Fourth* Day of *September 1979*

[SEAL]

*Attest:*

LUTRELLE F. PARKER

*Attesting Officer* *Acting Commissioner of Patents and Trademarks*